US006135589A

United States Patent [19]

Nakagomi et al.

[11] Patent Number: 6,135,589

[45] **Date of Patent: *Oct. 24, 2000**

[54] INK JET RECORDING HEAD WITH EJECTION OUTLET FORMING MEMBER AND URGING MEMBER FOR ASSEMBLING THE HEAD, AND APPARATUS WITH SUCH A HEAD

[75] Inventors: Hiroshi Nakagomi, Yamato; Teruo Arashima, Yokohama; Kunihiko Maeoka, Kawasaki; Takashi Ohba, Zama; Jun Kawai, Yokohama; Tsutomu Abe, Isehara; Hiroshi Sugitani, Machida; Yoshifumi Hattori, Yamato; Masami Ikeda, Tokyo; Asao Saito, Yokohama; Kazuaki Masuda, Sagamihara; Akio Saito, Hadano; Makiko Kimura, Sagamihara; Toshio Kashino, Chigasaki; Hideo Saikawa, Kawasaki; Seiichiro Karita, Yokohama; Tsuyoshi Orikasa, Kasukabe, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/888,604

[22] Filed: Jul. 7, 1997

Related U.S. Application Data

[60] Continuation of application No. 08/555,340, Nov. 8, 1995, abandoned, which is a division of application No. 08/434,843, May 4, 1995, Pat. No. 5,485,184, which is a division of application No. 08/344,626, Nov. 17, 1994, Pat. No. 5,436,649, which is a continuation of application No. 08/101,287, Aug. 3, 1993, abandoned, which is a continuation of application No. 07/583,168, Sep. 17, 1990, abandoned.

[30] Foreign Application Priority Data

| | | | |
|---|---|---|---|
| Sep. 18, 1989 | [JP] | Japan | 1-241029 |
| Sep. 18, 1989 | [JP] | Japan | 1-241046 |
| Sep. 18, 1989 | [JP] | Japan | 1-241047 |
| Sep. 18, 1989 | [JP] | Japan | 1-241051 |
| Sep. 18, 1989 | [JP] | Japan | 1-241056 |

[51] Int. Cl.[7] ..... B41J 2/05; B41J 2/015; B41J 2/14

[52] U.S. Cl. ..... 347/63; 347/20; 347/49

[58] Field of Search ..... 347/20, 44, 63, 347/65, 49

[56] References Cited

U.S. PATENT DOCUMENTS

| | | |
|---|---|---|
| 4,313,124 | 1/1982 | Hara . |
| 4,314,259 | 2/1982 | Cairns et al. . |

(List continued on next page.)

FOREIGN PATENT DOCUMENTS

| | | |
|---|---|---|
| 2728657 | 1/1979 | Germany . |
| 54-56847 | 5/1979 | Japan . |

(List continued on next page.)

*Primary Examiner*—John Barlow
*Assistant Examiner*—An H. Do
*Attorney, Agent, or Firm*—Fitzpatrick, Cella, Harper & Scinto

[57] ABSTRACT

An ink jet head includes a first member with an energy generating element for generating energy to eject ink, a second member having an ejection outlet forming member provided with an ink ejection outlet through which the ink is ejected, the second member being affixed to the first member to form a liquid passage in fluid communication with the ejection outlet, and urging means for urging the first and second members together to substantially fix them against each other. The ejection outlet forming member has a jaw connected with a surface of the first member which has the energy generating element, the jaw being adjacent a first member side of the ejection outlet. The following relationships are satisfied, namely, b≧5 microns, c≧3 microns, and a+b is between 20 and 60 microns, where a is the thickness of the ejection outlet forming member, b is a depth of the jaw, and c is a distance between a connecting portion between the ejection outlet forming member and the first member and an inside end of the ejection outlet.

5 Claims, 12 Drawing Sheets

U.S. PATENT DOCUMENTS

| | | | |
|---|---|---|---|
| 4,330,787 | 5/1982 | Sato et al. . | |
| 4,345,262 | 8/1982 | Shirato et al. . | |
| 4,394,670 | 7/1983 | Sugitani et al. . | |
| 4,412,224 | 10/1983 | Sugitani . | |
| 4,417,251 | 11/1983 | Sugitani . | |
| 4,450,455 | 5/1984 | Sugitani et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,568,953 | 2/1986 | Aoki et al. . | |
| 4,599,528 | 7/1986 | Doring et al. . | |
| 4,611,219 | 9/1986 | Sugitani et al. . | |
| 4,644,369 | 2/1987 | Gamblin et al. . | |
| 4,666,823 | 5/1987 | Yokota et al. . | |
| 4,686,544 | 8/1987 | Ikeda et al. . | |
| 4,723,129 | 2/1988 | Endo et al. . | |
| 4,725,851 | 2/1988 | Sutera et al. . | |
| 4,725,859 | 2/1988 | Shibata et al. . | |
| 4,740,796 | 4/1988 | Endo et al. . | |
| 4,779,099 | 10/1988 | Lewis . | |
| 5,095,321 | 3/1992 | Saito et al. . | |
| 5,148,192 | 9/1992 | Izumida et al. . | |
| 5,148,203 | 9/1992 | Hirano . | |
| 5,162,818 | 11/1992 | Karita et al. . | |
| 5,187,497 | 2/1993 | Hirano et al. . | |
| 5,189,443 | 2/1993 | Arashima et al. . | |
| 5,208,604 | 5/1993 | Watanabe et al. . | |
| 5,216,446 | 6/1993 | Satoi et al. . | |
| 5,216,448 | 6/1993 | Unosawa et al. . | |
| 5,237,342 | 8/1993 | Saikawa et al. . | |
| 5,262,802 | 11/1993 | Karita et al. . | |
| 5,280,299 | 1/1994 | Saikawa et al. . | |
| 5,384,586 | 1/1995 | Hirano et al. | 346/134 |
| 5,389,957 | 2/1995 | Kimura et al. | 347/20 |
| 5,436,649 | 7/1995 | Nakagomi et al. | 347/20 |
| 5,485,184 | 1/1996 | Nakagomi et al. | 347/63 |

FOREIGN PATENT DOCUMENTS

| | | | |
|---|---|---|---|
| 59-123670 | 7/1984 | Japan . | |
| 59-138461 | 8/1984 | Japan . | |
| 60-71260 | 4/1985 | Japan . | |
| 1-78845 | 3/1989 | Japan | 347/49 |
| 2130528 | 6/1984 | United Kingdom . | |

INK JET RECORDING HEAD WITH EJECTION OUTLET FORMING MEMBER AND URGING MEMBER FOR ASSEMBLING THE HEAD, AND APPARATUS WITH SUCH A HEAD

This application is a continuation of application Ser. No. 08/555,340 filed Nov. 8, 1995, now abandoned, which was a division of application Ser. No. 08/434,843, filed May 4, 1995, now U.S. Pat. No. 5,485,184, which is a division of application Ser. No. 08/344,626, filed Nov. 17, 1994, now U.S. Pat. No. 5,436,649, which is a continuation of application Ser. No. 08/101,287, filed Aug. 3, 1993, which was a continuation of application Ser. No. 07/583,168, filed Sep. 17, 1990, both now abandoned.

FIELD OF THE INVENTION AND RELATED ART

The present invention relates to an ink jet recording head and an ink jet recording apparatus using the same.

It is known that an ink jet recording head is an assembly with various parts. When the parts are coupled screws, leaf springs are used. In the case of leaf springs using the elastic force thereof, a base member and a top plate for formation of the ink passages are secured by a leaf spring having a large width in a conventional ink jet recording head. In some of the recording heads, an orifice plate is used, but the positional adjustment thereof is difficult because of various requirements. It is also known that the parts are temporarily bonded for the convenience of the final coupling.

An "M" shaped leaf spring is conventionally used to couple two parts, utilizing the surface pressure force of the flat portion of the leaf springs.

However, the pressure is not concentrated to the central portion, and therefore, the pressure is not uniformly distributed to the contact surface with the result of reduction of the pressure at the central portion.

If this applies to the ink jet recording head, the pressure between the top plate with grooves for defining the ink passages and the leaf spring is not uniform. Then, a gap is formed between the adjacent ink passages. As a result, the pressure formed on the base plate in a passage is transmitted to the adjacent ink passage with the result of unstable ink ejection speed or deviated ink ejection or cross-talk in which the ink is ejected through a passage other than the intended passage. If this occurs, the grade of the print is lowered, of course. In the conventional recording head, the top plate is made of resin material, so that the surface pressure results in warp of the top plate by the pressure with the result of difficulty of uniformly pressing the ejection outlet portion. In addition, the unavoidable variation in the manufacturing of the leaf spring means, the accuracy of the pressure is varied.

SUMMARY OF THE INVENTION

It is an object of the present invention to provide an ink jet recording head and an ink jet recording apparatus using same wherein the ink ejection is stabilized with simple structure.

It is another object of the present invention to provide an ink jet recording head and an ink jet recording apparatus using the same wherein a part can be uniformly pressed to another part in the clamping therebetween.

It is a further object of the present invention to provide an ink jet recording head and an ink jet recording apparatus using the same wherein the cross-talk is prevented.

According to an aspect of the present invention, a line pressure, rather than a surface pressure, is used to press the top plate to a base plate. Inventors' experiments and investigations have revealed that the line pressure is able to provide a solution to the above-described problems. More particularly, where a top plate having grooves for constituting ink passages is coupled with a base member to define a closed passage, they are clamped by a clamping member applying a line pressure.

According to an embodiment of the present invention, a part of a leaf spring is bent at substantially 90 degrees, and the bent portion is used to press the member, then the line pressure is easily applied.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 12A, 12B and 12C show examples of ink jet recording heads according to the embodiments of the present invention, wherein FIG. 12A is a perspective view of the top plate with the grooves; FIG. 12B is a perspective view of the recording head; and FIG. 12C is a sectional view of the recording head of FIG. 12B.

DESCRIPTION OF THE PREFERRED EMBODIMENTS

FIGS. 2, 3, 4, 5 and 6 illustrate an ink jet unit IJU, an ink jet head IJH, an ink container IT, an ink jet cartridge IJC, a head carriage HC and a main assembly IJRA of an ink jet recording apparatus, according to an embodiment of the present invention, and relations among them. The structures of the respective elements will be described in the following.

Figure 2:
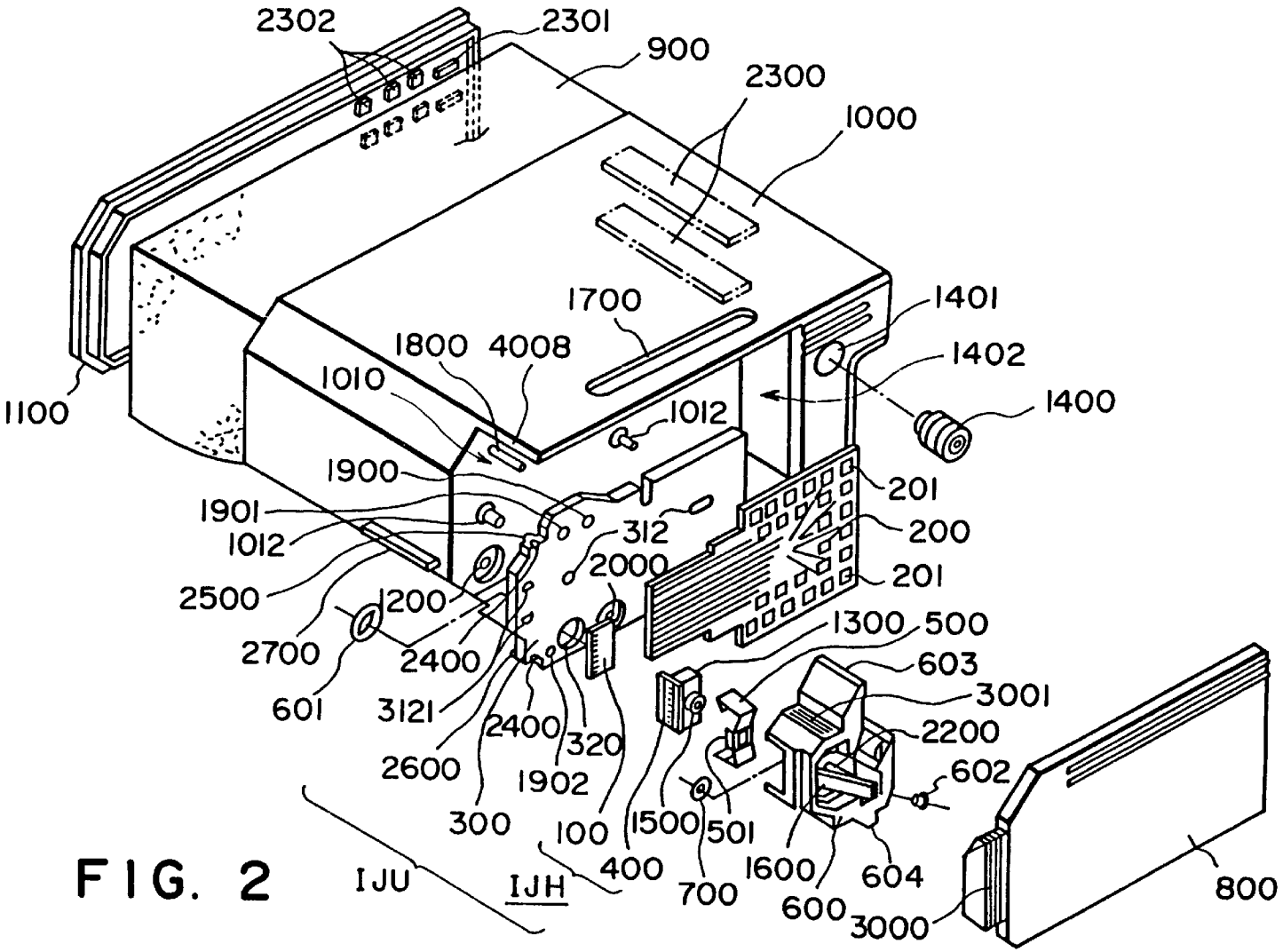
FIG. 2 is an exploded perspective view of an example of an ink jet cartridge according to an embodiment of the present invention.
Figure 3:
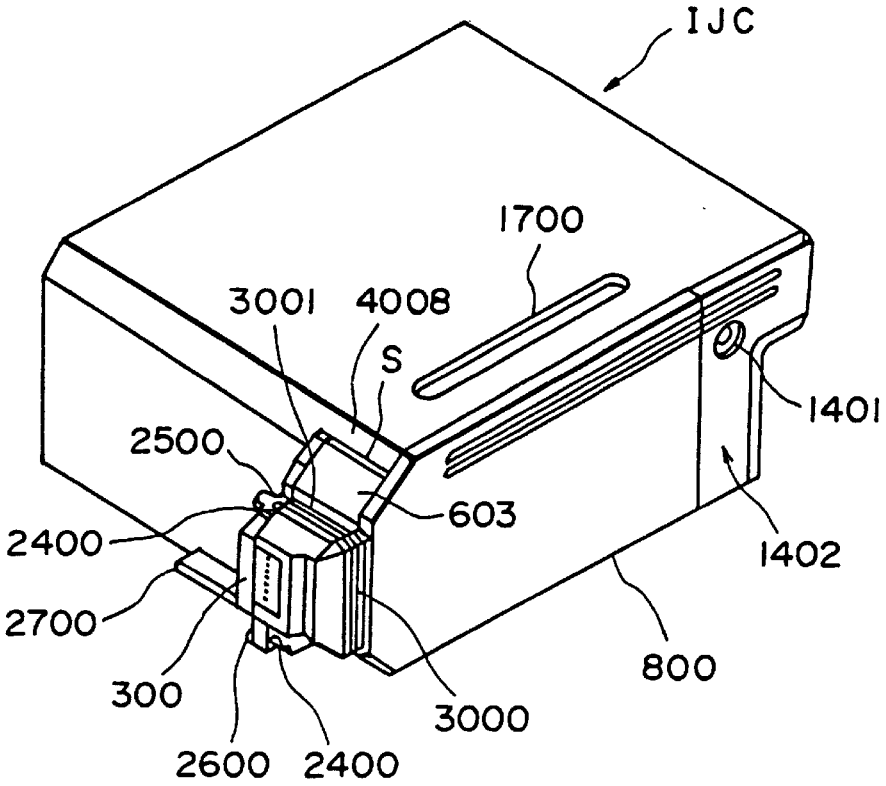
FIG. 3 is a perspective view of an ink jet cartridge according to another embodiment of the present invention.

As will be understood from the perspective view of FIG. 3, the ink jet cartridge IJC in this embodiment has a relatively large ink accommodation space, and an end portion of the ink jet unit IJU is slightly projected from the front side surface of the ink container IT. The ink jet cartridge IJC is mountable at correct position on the carriage HC (FIG. 5) of the ink jet recording apparatus main assembly IJRA by proper positioning means and with electric contacts, which will be described in detail hereinafter. It is, in this embodiment, a disposable type head detachably mountable on the carriage HC. The structures disclosed in FIGS. 2–6 contain various novel features, which will first be described generally.

(i) Ink Jet Unit IJU

The ink jet unit IJU is of a bubble jet recording type using electrothermal transducers which generate thermal energy, in response to electric signals, to produce film boiling of the ink.

Referring to FIG. 2, the unit comprises a heater board 100 having electrothermal transducers (ejection heaters) arranged in a line on an Si substrate and electric lead lines made of aluminum or the like to supply electric power thereto. The electrothermal transducer and the electric leads are formed by a film forming process. A wiring board 200 is associated with the heater board 100 and includes wiring corresponding to the wiring of the heater board 100 (connected by the wire bonding technique, for example) and pads 201 disposed at an end of the wiring to receive electric signals from the main assembly of the recording apparatus.

A top plate 1300 is provided with grooves which define partition walls for separating adjacent ink passages and a common liquid chamber for accommodating the ink to be supplied to the respective ink passages. The top plate 1300 is formed integrally with an ink jet opening 1500 for receiving the ink supplied from the ink container IT and directing the ink to the common chamber, and also with an orifice plate 400 having the plurality of ejection outlets corresponding to the ink passages. The material of the integral mold is preferably polysulfone, but may be another molding resin material.

A supporting member 300 is made of metal, for example, and functions to support a backside of the wiring board 200 in a plane, and constitutes a bottom plate of the ink jet unit IJU. A confining spring 500 is in the form of "M" having a central portion urging to the common chamber with a light pressure, and a clamp 501 urges concentratedly with a line pressure to a part of the liquid passage, preferably the part in the neighborhood of the ejection outlets. The confining spring 500 has legs for clamping the heater board 100 and the top plate 1300 by penetrating through the openings 3121 of the supporting plate 300 and engaging the back surface of the supporting plate 300. Thus, the heater board 100 and the top plate 1300 are clamped by the concentrated urging force by the legs and the clamp 501 of the spring 500. The supporting plate 300 has positioning openings 312, 1900 and 2000 engageable with two positioning projections 1012 and positioning and fuse-fixing projections 1800 and 1801 of the ink container IT. It further includes projections 2500 and 2600 at its backside for the positioning relative to the carriage HC of the main assembly IJRA.

In addition, the supporting member 300 has a hole 320 through which an ink supply pipe 2200, which will be described hereinafter, is penetrated for supplying ink from the ink container. The wiring board 200 is mounted on the supporting member 300 by bonding agent or the like. The supporting member 300 is provided with recesses 2400 and 2400 adjacent the positioning projections 2500 and 2600.

Figure 5:
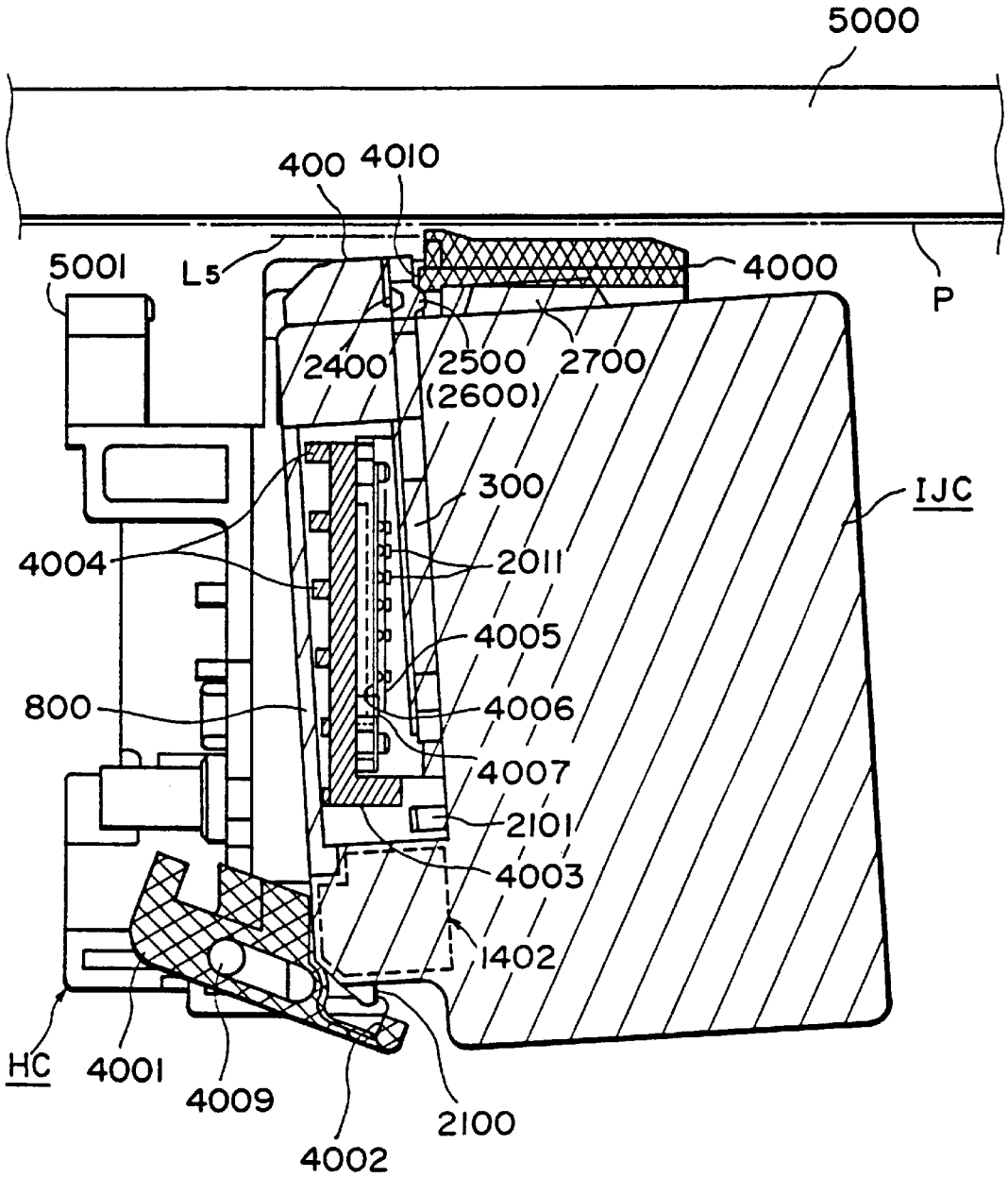
FIG. 5 is a top plan view illustrating the mounting of the ink jet cartridge to a carriage of an ink jet recording apparatus.

As shown in FIG. 3, the assembled ink jet cartridge IJC has a head projected portion having three sides provided with plural parallel grooves 3000 and 3001. The recesses 2400 and 2400 are located at extensions of the parallel grooves at the top and bottom sides to prevent the ink or foreign matter moving along the groove from reaching the projections 2500 and 2600. The covering member 800 having the parallel grooves 3000, as shown in FIG. 5, constitutes an outer casing of the ink jet cartridge IJC and cooperates with the ink container to define a space for accommodating the ink jet unit IJU. The ink supply member 600 having the parallel groove 3001 has an ink conduit pipe 1600 communicating with the above-described ink supply pipe 2200 and cantilevered at the supply pipe 2200 side. In order to assure the capillary action at the fixed side of the ink conduit pipe 1600 and the ink supply pipe 2200, a sealing pin 602 is inserted.

A gasket 601 seals the connecting portion between the ink container IT and the supply pipe 2200. A filter 700 is disposed at the container side end of the supply pipe. The ink supply member 600 is molded, and therefore, it is produced at low cost with high positional accuracy. In addition, the cantilevered structure of the conduit 1600 assures the press-contact between the conduit 1600 and the ink inlet 1500 even if the ink supply member 600 is mass-produced.

In this embodiment, the complete communicating state can be assuredly obtained simply by flowing sealing bonding agent from the ink supply member side under the press-contact state. The ink supply member 600 may be fixed to the supporting member 300 by inserting and penetrating backside pins (not shown) of the ink supply member 600 through the openings 1901 and 1902 of the supporting member 300 and by heat-fusing the portion where the pins are projected through the backside of the supporting member 300. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 1000, an ink absorbing material and a cover member 1100. The ink absorbing material 900 is inserted into the main body 1000 from the side opposite from the unit (IJU) mounting side, and thereafter, the cover member 1100 seals the main body.

The ink absorbing material 900 is thus disposed in the main body 1000. The ink supply port 1200 functions to supply the ink to the ink jet unit IJU comprising the above-described parts 100–600, and also functions as an ink injection inlet to permit initial ink supply to the absorbing material 900 before the unit IJU is mounted to the portion 1010 of the main body.

In this embodiment, the ink may be supplied through an air vent port and this supply opening. In order to ensure good supply of ink, ribs 2300 are formed on the inside surface of the main body 1000, and ribs 2301 and 2302 are formed on the inside of the cover member 1100, which are effective to provide within the ink container an ink existing region extending continuously from the air vent port side to that corner portion of the main body which is most remote from the ink supply opening 1200. Therefore, in order to uniformly distribute the ink in good order, it is preferable that the ink is supplied through the supply opening 1200. This ink supply method is practically effective. The number of the ribs 2300 in this embodiment is four, and the ribs 2300 extend parallel to a movement direction of the carriage adjacent the rear side of the main body of the ink container, by which the absorbing material 900 is prevented from closely contacting the inner surface of the rear side of the main body. The ribs 2301 and 2302 are formed on the inside surface of the cover member 1100 at a position which is substantially an extension of the ribs 2300. However, as contrasted to the large rib 2300, the size of the ribs 2301 and 2302 are small as if it is divided ribs, so that the air existing space is larger with the ribs 2301 and 2302 than with the rib 2300. The ribs 2302 and 2301 are distributed on the entire area of the cover member 1100, and the area thereof is not more than one half of the total area. Because of the provisions of the ribs, the ink in the corner region of the ink absorbing material which is most remote from the supply opening 1200 can be stably and assuredly supplied to the inlet opening by capillary action. The cartridge is provided with an air vent port for communication between the inside of the cartridge with the outside air. Inside the vent port 1400, there is a water repellent material to prevent the inside ink from leaking outside through the vent port 1400.

The ink accommodating space in the ink container IT is substantially rectangular parallelepiped, and the long side faces in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 1100 to stabilize the ink supply from the ink absorbing material 900. The cube configuration is preferable from the standpoint of accommodating as much ink as possible in limited space. However, from the standpoint of using the ink with minimum an available part in the ink container, the provisions of the ribs formed on the two surfaces constituting a corner.

In this embodiment, the inside ribs 2301 and 2302 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having the center at the projected position on the ink supply opening 1200 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

In this embodiment, the backside of the ink jet cartridge IJC is flat, and therefore, the space required when mounted in the apparatus is minimized, while maintaining the maximum ink accommodating capacity. Therefore, the size of the apparatus can be reduced, and simultaneously, the frequency of the cartridge exchange is minimized. Utilizing the rear space of the space used for unifying the ink jet unit IJU, a projection for the air vent port 1401 is provided. The inside of the projection is substantially vacant, and the vacant space 1402 functions to supply the air into the ink container IT uniformly in the direction of the thickness of the absorbing material. Because of these features described above, the cartridge as a whole is of better performance than the conventional cartridge. The air supply space 1402 is much larger than that in the conventional cartridge. In addition, the air vent port 1401 is at an upper position, and therefore, if the ink departs from the absorbing material for some reason or another, the air supply space 1402 can temporarily retain the ink to permit such ink to be absorbed back into the absorbing material. Therefore, the wasteful consumption of the ink can be saved.

Figure 4:
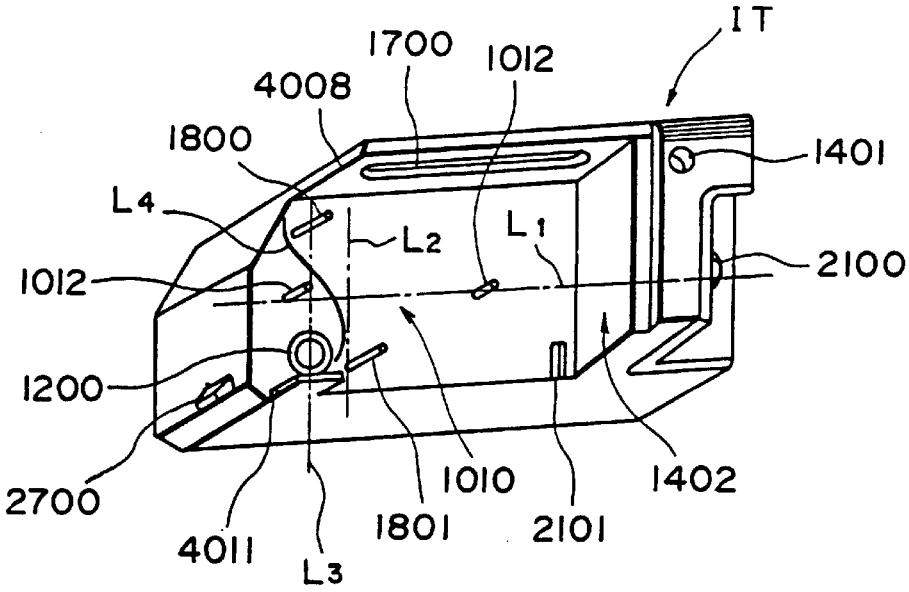
FIG. 4 is a perspective view of an ink container of an ink jet cartridge, as seen from a side at which the ink jet recording head is mounted.

Referring to FIG. 4, there is shown a structure of a surface of the ink container IT to which the unit IJU is mounted. Two positioning projections 1012 are on a line L1 which is a line passing through the substantial center of the array of the ejection outlets in the orifice plate 400 and parallel with the bottom surface of the ink container IT or the parallel to the ink container supporting reference surface of the carriage. The height of the projections 1012 is slightly smaller than the thickness of the supporting member 300, and the projections 1012 function to correctly position the supporting member 300. On an extension (right side) in this Figure, there is a pawl 2100 with which a right angle engaging surface 4002 of a carriage positioning hook 4001 is engageable. Therefore, the force for the positioning of the ink jet unit relative to the carriage acts in a plane parallel to a reference plane including the line L1. These relationships are significant, since the accuracy of the ink container positioning becomes equivalent to the positioning accuracy of the ejection outlet of the recording head, which will be described hereinafter in conjunction with FIG. 5.

Projections 1800 and 1801 corresponding to the fixing holes 1900 and 2000 for fixing the supporting member 300 to the side of the ink container IT, are longer than the projections 1012, so that they penetrate through the supporting member 300, and the projected portions are fused to fix the supporting member 300 to the side surface. When a line L3 passing through the projection 1800 and perpendicular to the line L1, and a line L2 passing through the projection 1801 and perpendicular to the line L1, are drawn, the center of the supply opening 1200 is substantially on the line L3, the connection between the supply opening 1200 and a supply pipe 2200 is stabilized, and therefore, even if the cartridge falls, or even if a shock is imparted to the cartridge, the force applied to the connecting portion can be minimized. In addition, since the lines L2 and L3 are not overlapped, and since the projections 1800 and 1801 are disposed adjacent to that projection 1012 which is nearer to the ink ejection outlets of the ink jet head, the positioning of the ink jet unit relative to the ink container is further improved. In this Figure, a curve L4 indicates the position of the outer wall of the ink supply member 600 when it is mounted. Since the projections 1800 and 1801 are along the curve L4, the projections are effective to provide sufficient mechanical strength and positional accuracy against the weight of the end structure of the head IJH.

An end projection 2700 of the ink container IT is engageable with a hole formed in the front plate 4000 of the carriage to prevent the ink cartridge from being displaced extremely out of the position. A stopper 2101 is engageable with an unshown rod of the carriage HC, and when the cartridge IJC is correctly mounted with rotation, which will be described hereinafter, the stopper 2101 takes a position below the rod, so that even if an upward force tending to disengage the cartridge from the correct position is unnecessarily applied, the correct mounted state is maintained. The ink container IT is covered with a cover 800 after the unit IJU is mounted thereto. Then, the unit IJU is enclosed therearound except for the bottom thereof. However, the bottom opening thereof permits the cartridge IJC to be mounted on the carriage HC, and is close to the carriage HC, and therefore, the ink jet unit is substantially enclosed at the six sides. Therefore, the heat generation from the ink jet head IJH which is in the enclosed space is effective to maintain the temperature of the enclosed space.

However, if the cartridge IJC is continuously operated for a long period of time, the temperature slightly increases. Against the temperature increase, the top surface of the cartridge IJC is provided with a slit 1700 having a width smaller than the enclosed space, by which the spontaneous heat radiation is enhanced to prevent the temperature rise, while the uniform temperature distribution of the entire unit IJU is not influenced by the ambient conditions.

After the ink jet cartridge IJC is assembled, the ink is supplied from the inside of the cartridge to the chamber in the ink supply member 600 through a supply opening 1200, the hole 320 of the supporting member 300 and an inlet formed in the backside of the ink supply member 600. From the chamber of the ink supply member 600, the ink is supplied to the common chamber through the outlet, supply pipe and an ink inlet 1500 formed in the top plate 1300. The connecting portion for the ink communication is sealed by silicone rubber or butyl rubber or the like to assure the hermetical seal.

In this embodiment, the top plate 1300 is made of resin material having resistivity to the ink, such as polysulfone, polyether sulfone, polyphenylene oxide, polypropylene. It is integrally molded in a mold together with an orifice plate portion 400.

As described in the foregoing, the integral part comprises the ink supply member 600, the top plate 1300, the orifice plate 400 and parts integral therewith, and the ink container body 1000. Therefore, the accuracy in the assembling is improved, and is convenient in the mass-production. The number of parts is smaller than conventional device, so that the good performance can be assured.

In this embodiment, as shown in FIGS. 2–4, the configuration after assembly is such that the top portion 603 of the ink supply member 600 cooperates with an end of the top thereof having the slits 1700, so as to form a slit S, as shown in FIG. 3. The bottom portion 604 cooperates with feed side end 4011 of a thin plate to which the bottom cover 800 of the ink container IT is bonded, so as to form a slit (not shown) similar to the slit S. The slits between the ink container IT and the ink supply member 600 are effective to enhance the heat radiation, and is also effective to prevent an expected pressure to the ink container IT from influencing directly the supply member or to the ink jet unit IJU.

The above-described various structures are individually effective to provide the respective advantages, and also they are most effective when they are combined with each other.

(iii) Mounting of the Ink Jet Cartridge IJC to the Carriage HC

In FIG. 5, a platen roller 5000 guides the recording medium P from the bottom to the top. The carriage HC is movable along the platen roller 5000. The carriage HC comprises a front plate 4000, a supporting plate 4003 for electric connection and a positioning hook 4001. The front plate 4000 has a thickness of 2 mm, and is disposed closer to the platen. The front plate 4000 is disposed close to the front side of the ink jet cartridge IJC, when the cartridge IJC is mounted to the carriage. The supporting plate 4003 supports a flexible sheet 4005 having pads 2011 corresponding to the pads 201 of the wiring board 200 of the ink jet cartridge IJC and a rubber pad sheet 4007 for producing elastic force for urging the backside of the flexible sheet 4005 to the pads 2001. The positioning hook 4001 functions to fix the ink jet cartridge IJC to the recording position. The front plate 4000 is provided with two positioning projection surfaces 4010 corresponding to the positioning projections 2500 and 2600 of the supporting member 300 of the cartridge described hereinbefore. After the cartridge is mounted, the front plate receives the force in the direction perpendicular to the projection surfaces 4010. Therefore, plural reinforcing ribs (not shown) are extended in the direction of the force at the platen roller side of the front plate. The ribs project toward the platen roller slightly (approximately 0.1 mm) from the front side surface position L5 when the cartridge IJC is mounted, and therefore, they function as head protecting projections. The supporting plate 4003 is provided with plural reinforcing ribs 4004 extending in a direction perpendicular to the above-described front plate ribs. The reinforcing ribs 4004 have heights which decrease from the plate roller side to the hook 4001 side. By this, the cartridge is inclined as shown in FIG. 5, when it is mounted.

The supporting plate 4003 is provided with two additional positioning surfaces 4006 at the lower left portion, that is, at the position closer to the hook. The positioning surfaces 4006 correspond to projection surfaces 4010. By the additional positioning surfaces 4006, the cartridge receives the force in the direction opposite from the force received by the cartridge by the above-described positioning projection surfaces 4010, so that the electric contacts are stabilized. Between the upper and lower projection surfaces 4010, there is disposed a pad contact zone, so that the amount of deformation of the projections of the rubber sheet 4007 corresponding to the pad 2011 is determined. When the cartridge IJC is fixed at the recording position, the positioning surfaces are brought into contact with the surface of the supporting member 300. In this embodiment, the pads 201 of the supporting member 300 are distributed so that they are symmetrical with respect to the above-described line L1, and therefore, the amount of deformation of the respective projections of the rubber sheet 4007 are made uniform to stabilize the contact pressure of the pads 2011 and 201. In this embodiment, the pads 201 are arranged in two columns and upper and bottom two rows.

The hook 4001 is provided with an elongated hole engageable with a fixed pin 4009. Using the movable range provided by the elongated hole, the hook 4001 rotates in the counterclockwise direction, and thereafter, it moves leftwardly along the platen roller 5000, by which the ink jet cartridge IJC is positioned to the carriage HC. Such a movable mechanism of the hook 4001 may be accomplished by another structure, but it is preferable to use a lever or the like. During the rotation of the hook 4001, the cartridge IJC moves from the position shown in FIG. 5 to the position toward the platen side, and the positioning projections 2500 and 2600 come to the position where they are engageable to the positioning surfaces 4010. Then, the hook 4001 is moved leftwardly, so that the hook surface 4002 is contacted to the pawl 2100 of the cartridge IJC, and the ink cartridge IJC rotates about the contact between the positioning surface 2500 and the positioning projection 4010 in a horizontal plane, so that the pads 201 and 2011 are contacted to each other. When the hook 4001 is locked, that is retained at the fixing or locking position, by which the complete contacts are simultaneously established between the pads 201 and 2011, between the positioning portions 2500 and 4010, between the standing surface 4002 and the standing surface of the pawl and between the supporting member 300 and the positioning surface 4006, and therefore, the cartridge IJC is completely mounted on the carriage.

(iv) General Arrangement of the Apparatus

Figure 6:
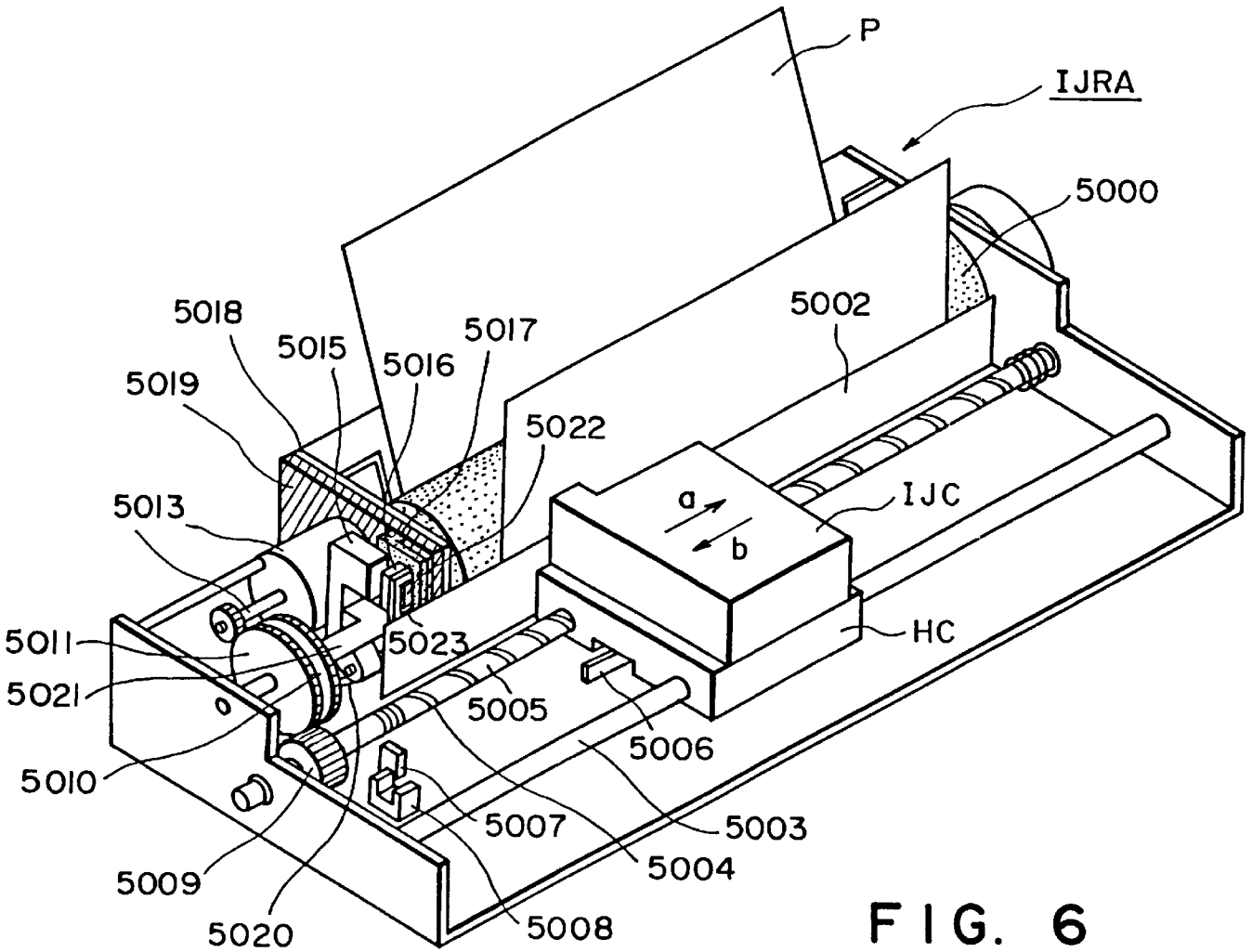
FIG. 6 is a perspective view of an ink jet recording apparatus according to an embodiment of the present invention.

FIG. 6 is a perspective view of an ink jet recording apparatus IJRA in which the present invention is used. A lead screw 5005 rotates by way of a drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck the recording head through the opening 5023 of the cap so as to recover the recording head.

A cleaning blade 5017 is moved toward front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as clutch or the like.

The capping, cleaning and sucking operations can be performed when the carriage is at the home position by the lead screw 5005, in this embodiment. However, the present invention is usable in another type of system wherein such operations are effected at different timing. The individual structures are advantageous, and in addition, the combination thereof is further preferable.

Figure 1A:
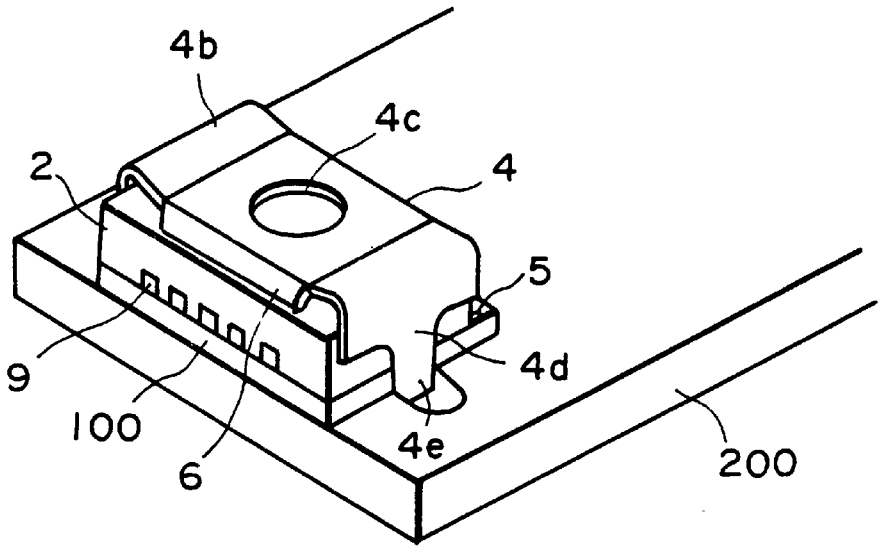
FIG. 1A is a perspective view of an ink jet recording head according to an embodiment of the present invention.
Figure 1B:
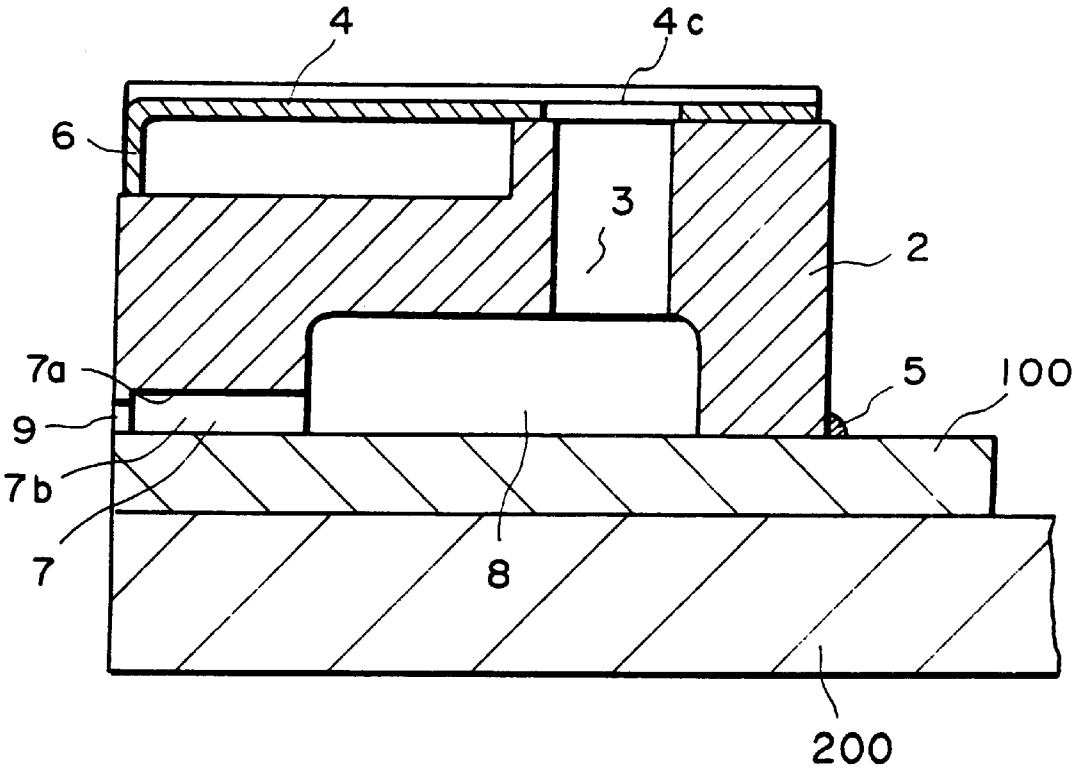
FIG. 1B is a sectional view of the ink jet recording head of FIG. 1A.

Referring to FIGS. 1A and 1B, there is shown in perspective view and sectional view a part of the ink jet recording head according to an embodiment of the present invention. The base plate 100 has plural ejection pressure generating means in the form of electrothermal transducers in this embodiment. The base plate is made of Si. Reference numeral 2 designates a top plate 2 made of resin. It includes a number of grooves 7*a* and walls 7*b* constituting a number of ink ejection outlets 9 and a number of ink passages 7. It also includes a common ink chamber 8 for containing the ink for supply to the respective ink passages. Reference numeral 200 designates a supporting plate made of aluminum and constituting a head. A leaf spring member 4 functions to mechanically confine or clamp the base plate 1 and the top plate 2 to constitute the ink passage 7 and the common ink chamber 8. It is made of phosphor bronze, spring stainless, FRP or the like. The leaf spring member 4 has a central opening 4C to permit ink supply to the ink receptor 3 of the recording head. Designated by a reference numeral 5 is a bonding agent or material for temporarily coupling the base plate 100 and the top plate 2. It is a photocuring bonding agent.

The leaf spring member 4 as shown in FIGS. 1A and 1B, includes a surface portion including the opening 4*c* and substantially parallel with the top surface of the top plate 2 and side surfaces 4*b* and 4*d* along joint surfaces between the base plate 1 and the top plate 2. It is generally in the form of "M". The side 4*d* includes an arm portion 4*e* for engagement with the supporting plate to apply pressure to the leaf spring member 4. The leaf spring member 4 has a line pressure applying portion 6 which is provided by bending from the top part thereof toward the top side of the top plate 2. By the line pressure applying portion 6, the base plate 1 and the top plate 2 are clamped by a line pressure, by which the force can be concentrated to the line to provide a uniform pressing force, so that the clamping is reliable.

In this embodiment, the leaf spring member 4 is made of phosphor bronze having a plate thickness of 0.15 mm. The total pressure provided thereby is 1 kg.

On the contrary, the conventional leaf spring member provides a surface pressure to urge the top of the top plate 2, and therefore, the force is not concentrated to the portion adjacent to the ejection outlets or the ink passage where the sure clamping is desired, thus the force is distributed on the top surface of the top plate 2. In addition, it has been difficult to apply uniform force to the ink passage walls 7*b* constituting the ink passages 7.

However, in this embodiment, the leaf spring member 4 has a line pressure generating portion 6 having a width of 0.15 mm, so that the uniform clamping is possible substantially all over the width adjacent the ejection outlets and the ink passage formed region. Therefore, the gaps between adjacent ink passages 7 can be assuredly prevented.

Therefore, the problem of instability in the ejection can be eliminated with certainty.

The provision of the opening 4*c* in the top is preferable because the force can be concentrated more to the line pressure generating portion 6.

Figure 7:
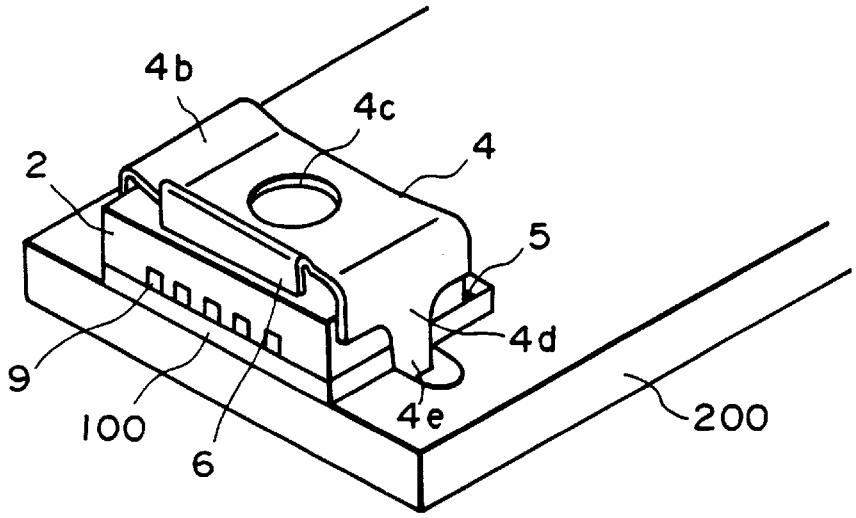
FIG. 7 is a perspective view of an ink jet recording head according to another embodiment of the present invention.

FIG. 7 shows another embodiment wherein the line pressure generating portion 6 is once bent away from the top plate 2 and is bent back toward the top plate. Therefore, substantially "V" shape is provided.

With this structure, the line pressure generating portion 6 itself is more elastic than in the embodiment of FIG. 1, so that the pressing force can be more easily adjusted so as to further make the pressure force uniform.

Figure 8:
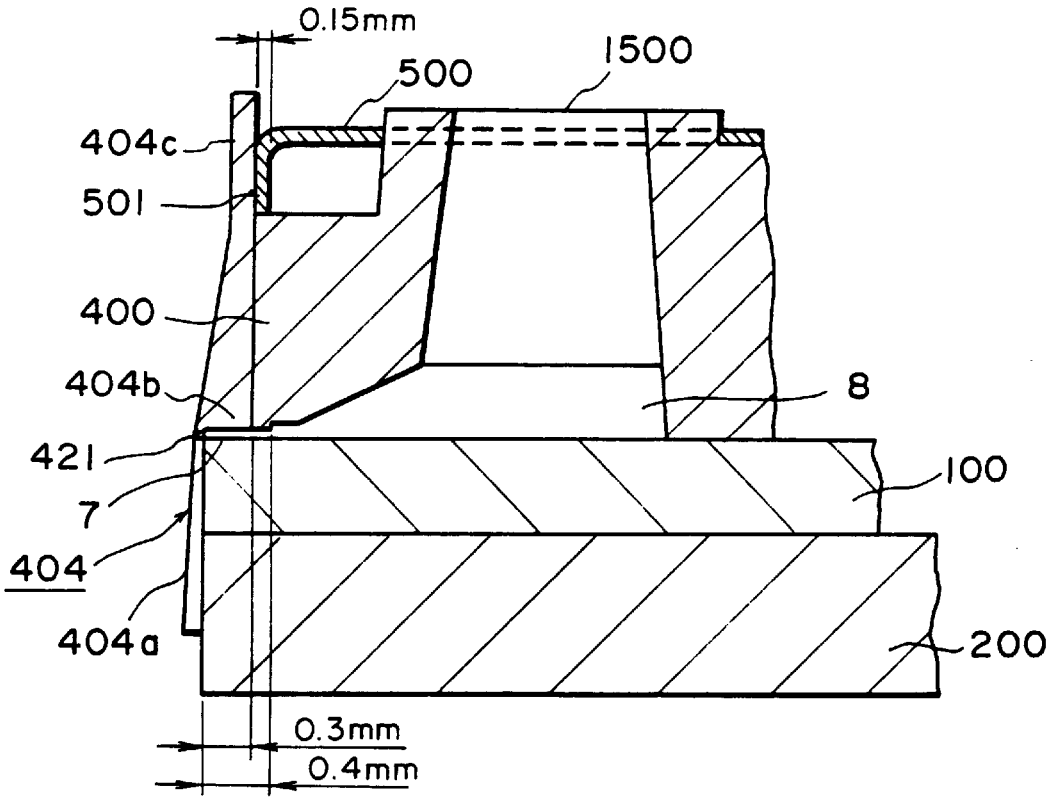
FIG. 8 is a perspective view of an ink jet recording head according to another embodiment of the present invention.

FIG. 8 is a partial enlarged view of FIG. 2 structure. The top plate 400 in this example has an orifice plate 404*b* in which the ink ejection outlets (orifices) are formed and a front plate 404*c*. The front plate 404*c* is integral with the outer periphery of the orifice plate and projected to the outside of the base plate 100. The present invention is conveniently applicable to such a type of recording head.

In this case, the outside surface of the line pressure generating portion 501 of the leaf spring member 500 are contacted to the outside surface of the front plate 404*c*. When the line pressure generating portion 501 is urged downwardly, some part of the force escapes outwardly, but the above structure is effective to confine the escaping force, so that all of the pressing force is applied downwardly, thus accomplishing the uniform clamping.

In this embodiment, the ink inlet 1500 is engageable with the opening 500 of the leaf spring to assure the positional accuracy of the line pressure generating portion 6. The provision of an engageable projection to correctly position the line pressure generating portion 6 utilizing the opening in the top thereof, is further preferable.

In the embodiment shown in FIG. 8, the distance from the end of the ink ejection outlet 9 to the boundary between the ink passage and the common chamber is 0.4 mm. The line pressure generating portion 6 is so disposed that it presses the portion 0.3 mm away from the ink ejection outlets 9.

The position on which the line pressure generating portion 6 acts is not limited to this example. However, it is preferable that at least the ink passage region provided by the coupling between the base plate and the top plate 2 or 12 is clamped. In addition, it is further preferable to press the region closer to the ejection outlets, and it is further preferable to press the region of the ejection outlets.

Figure 9:
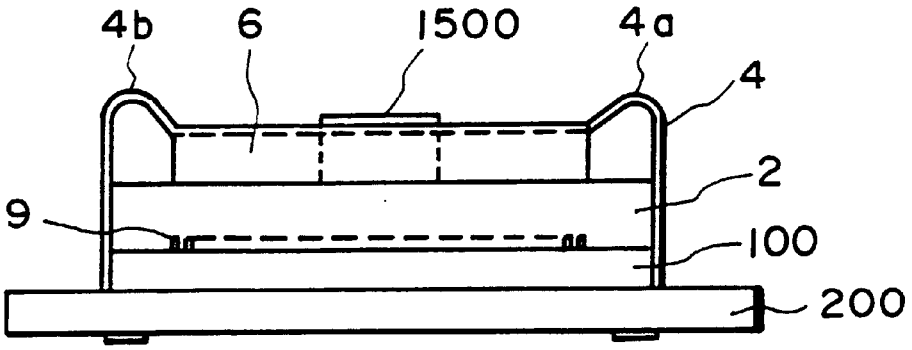
FIG. 9 is a front view of an ink jet recording head according to a further embodiment of the present invention.

It is particularly preferable that the pressing region provided by the line pressure generating portion 6 of the leaf spring member 4 covers the entire region where the ink passages communicate with the ink ejection outlets, as shown in FIG. 9.

The line pressure generating portion 6 preferably covers the entire width of the ejection outlet formed region or an inside region thereof to provide the proper pressure application.

In this embodiment, the top portion of the leaf spring member is out of contact with the top of the top plate 2, and therefore, that portion does not press the top of the top plate 2. By doing so, the application of the line pressure is stabilized, but it is possible that the pressure is applied by this top part of the leaf spring. In any case, by using a line pressure when clamping to members, the pressing force can be concentrated. It is possible to clamp the top plate and the base plate adjacent to the ejection outlets with uniform clamping or confining pressure. Therefore, the adjacent passages can be completely separated by the ink passage wall completely contacted to the base plate. Therefore, the ejection pressure does not transmit to the adjacent passage or passages. The ink droplet ejection is stabilized, so that the good quality of print can be provided at all times.

Figure 10:
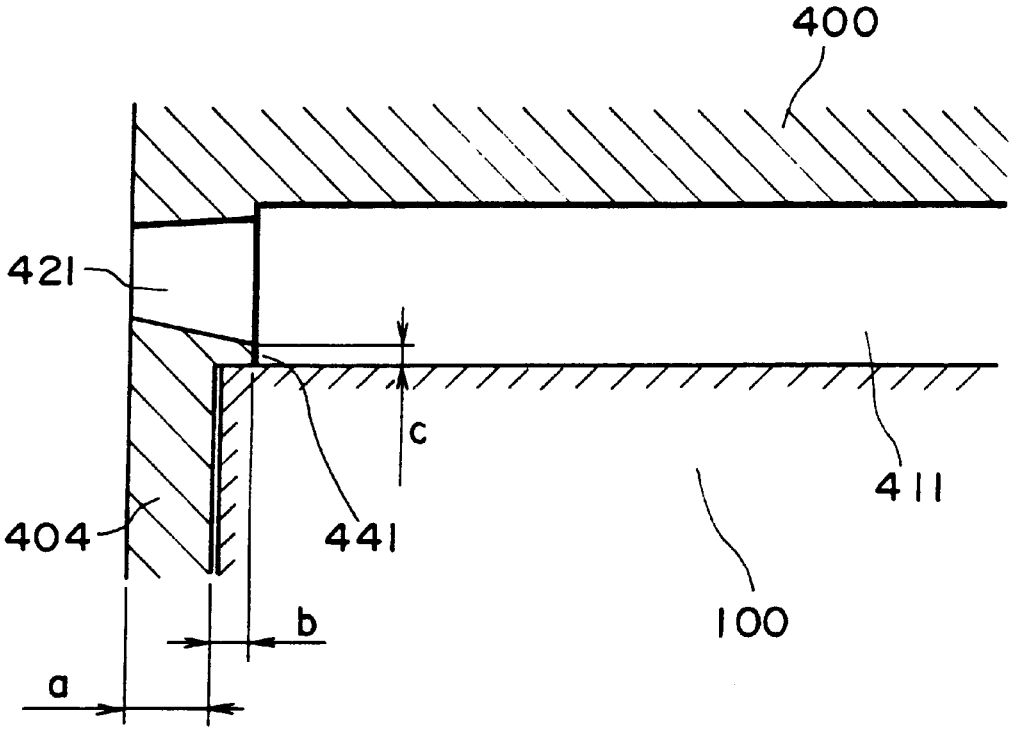
FIG. 10 is a sectional view of an orifice after a top plate and the heater board are coupled.
Figure 11:
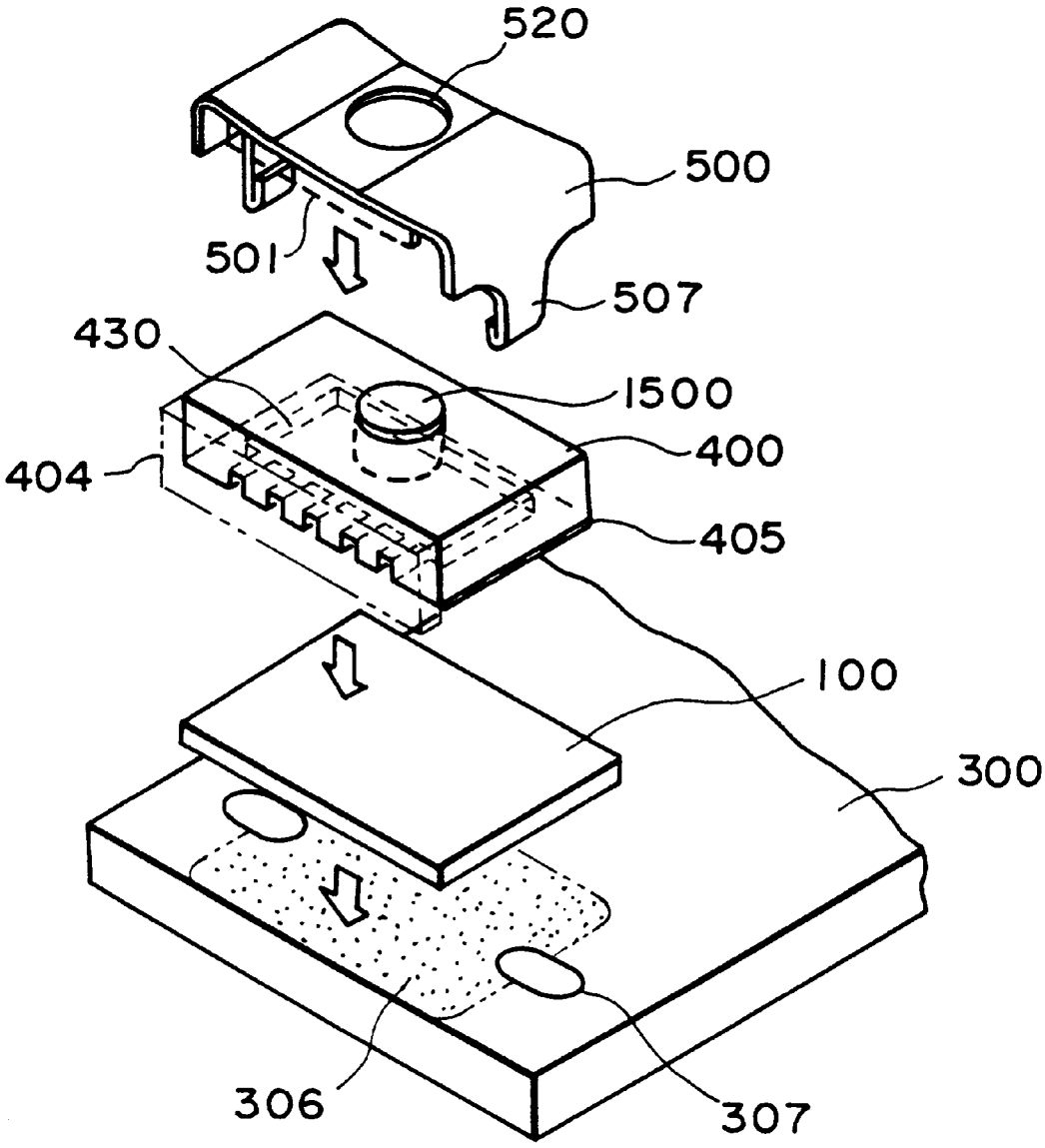
FIG. 11 is a perspective view illustrating the coupling between the heater board and the top plate.

Referring to FIGS. 10 and 11, the assembling of the recording head will be described.

FIG. 10 is a sectional view of a heater board adjacent the orifices and the ink passages after the top plate and the heater board is coupled, and after they are press-contacted by a confining spring.

In FIG. 10, reference numerals 421 and 422 designate orifices; 411 and 412 designate ink passages communicating with the orifices, respectively. The ink passages are further in communication with a recess 430 for formation of a common chamber.

In this embodiment, the top plate 400 is made of polysulfone, polyethersulfone, polyphenylene oxide, polypropylene resin or the like which exhibits good resistivity against the ink. It is integrally molded simultaneously with the orifice plate 404 in a mold.

The description will be made as to the method of formation of the ink passage grooves 411 and 412 and the orifices 421 and 422.

The ink passage grooves are provided by a resin mold having an opposite pattern of the grooves provided by machining or the like. Using the mold, the grooves 411 and 412 can be formed on the top plate 400.

As regards the orifices 421 and 422, an ultraviolet laser beam is projected to the inside of the orifice plate 404, that is, from the ink passage side, after the top plate is retracted from a mold. By the application of the laser beam, the resin is removed or evaporated, by which orifices 421 and 422 are formed.

In this embodiment, the groove has a width of 40 microns, and the walls have the width of 23.5 microns. The height of the ink passages (depth) is 40 microns. In the Figure, only two grooves are shown for the sake of simplicity, but actually, the number of grooves was 90, and the number of orifices formed by the excimer laser was 74. The thickness a of the orifice plate 404 is changed within the range of 10–60 microns. Also, the dimension b of a jaw, that is, the distance between an end surface 441 of the ink passage groove and the inside surface of the orifice plate 404 was changed within the range of 3–50 microns.

When the orifices are formed using the excimer laser, the position of the orifice 421 (422) in the passage 411 (412) is changed by changing a distance c between a bottom end of a circular hole in the front end 441 of the ink passage and the joint surface with the heater board 100 within the range of 2–10 microns.

The top plates having various dimensions a, b and c are produced, as shown in Table 1.

In tests Nos. 1–8, the thickness a of the orifice plate 404 was 20 microns, and the distance c was 5 microns, whereas the dimension b of the jaw was changed in the range of 3–50 microns.

In tests Nos. 9–15, the dimension b of the jaw was 10 microns, and the distance c was 5 microns, whereas the thickness a of the orifice plate 404 was changed in the range of 10–60 microns.

In tests Nos. 16–18, the thickness a of the orifice plate was 20 microns, and the dimension b of the jaw was 10 microns, whereas the distance c was changed in the range of 2–10 microns.

The recording heads were assembled using such various top plates. The method of manufacturing them are the same as described in the foregoing. It was confirmed that in tests Nos. 1–18, and tests Nos. 19–22, the gap between the passage walls of the top plate and the heater board was substantially 0 micron in any heads by the confining spring.

The evaluations of the recording head will be described. As a Comparison Example, Table 1 contains the case wherein the dimension b of the jaw is 0 micron (conventional structure).

The evaluations have been made as to (1) formability, (2) easiness in the orifice formation and (3) the recording head performance (cross-talk and print quality). As regards the formability, it is considered that if the thickness a of the orifice plate 404 of the top plate is too small, the flow of the resin during the molding would not be sufficient, so that the intended shape would not be provided. As regards the orifice formation, it is considered that if the duty of the laser beam (the thickness through which the laser beam has to penetrate), that is, the sum a+b of the thickness a and the dimension b, is too thick, the desired size or shape of the orifice could not be provided because of the limited power of the laser beam. As regards the cross-talk, the actual printing operation was performed, and the results of print were evaluated by observation.

In the tests Nos. 1–8, wherein the thickness a of the orifice plate 404 was 20 microns, and the distance c was 5 mm, whereas the dimension b of the jaw 440 was changed, the recording head No. 1 having the jaw dimension of 3 microns showed sufficient formability and sufficient orifice formation, but produced cross-talk, and the printing was not good. The head No. 2 having the jaw dimension of 5 microns, produced less frequent cross-talk as compared with the head No. 1. However, the cross-talk occurred sometimes, and the print quality was not completely sufficient. It is considered that because the jaw dimension is so small that the jaw is not contacted to the heater board at some places depending on the variations in the coupling between the heater board and the top plate, and therefore, the ejection power escapes into the adjacent passage.

The heads Nos. 3–6 having the jaw dimension of 10–30 microns, showed good formability, good orifice formation and did not produce the cross-talk with good printing quality. The head No. 7 having the jaw dimension of 40 microns showed good formability, did not produce the cross-talk with good printing quality, but the orifice formation was difficult. This is because the duty of the laser beam is 60 microns the jaw dimension reaches 40 microns and the thickness of the orifice plate is 20 microns. Therefore, the laser power and the processing period was increased to obtain the desired orifice size. In test No. 8 wherein the jaw dimension was 50 microns, the desired size of the orifice could not be produced, and therefore, the printing could not be evaluated, despite the laser being adjusted in various manners.

The evaluation of the test Nos. 9–16, wherein the jaw dimension b was 10 microns, the distance c was 5 microns, and the thickness of the orifice plate was changed in the range of 10–60 microns, are as follows. In the case of the thickness of 10 microns of the orifice plate 404, the resin could not be formed into the thickness of 10 microns (the resin did not flow into the mold, and therefore, the orifice plate was not molded). Therefore, the evaluation was not possible. The recording heads Nos. 10–15 having the orifice thickness of 15–50 microns, showed good formability, easy orifice formation, and did not produce the cross-talk, and the printing quality was good. However, the head No. 16 having the orifice plate thickness of 60 microns was not processed for the orifice formation by the laser, because the processing duty of the laser beam was 70 microns. Therefore, the printing operation for the evaluation was not possible.

Test Nos. 16–18 are as follows: the jaw dimension b was 10 microns, the orifice plate thickness a was 20 microns, and the distance c was changed between 2 microns, 3 microns and 10 microns. The head Nos. 17 and 18 having the distance c of 2 microns and 3 microns, respectively, produced cross-talk. The head No. 17 was worse, but head No. 18 produced a little cross-talk, and the printing quality was good.

The reason is considered as follows. Although the heater board 100 and the top plate 400 were press-contacted by the confining spring, the dimension C is so small that it is structurally not strong, with the result of the ejecting power being released to the adjacent passage. The heads having the c dimension of 10 microns did not show any problem in the printing quality.

In test Nos. 19–29, the jaw dimension was 0 micron, the heads all produced cross-talk and the printing quality was not sufficient. Therefore, it is understood that the cross-talk can not be suppressed sufficiently without the jaw.

In summary, the dimension b of the jaw is preferably not less than 5 microns from the standpoint of production of cross-talk. From the standpoint of formability, the thickness a of the orifice plate is preferably not less than 15 microns, and the sum of a+b is preferably not more than 60 microns from the standpoint of orifice formation using the excimer laser.

The distance c is preferably not less than 3 microns.

The results are summarized as follows:

(1) 20 microns$\leqq$a+b$\leqq$60 microns (2) b$\geqq$5 microns (3) c$\geqq$3 microns If the above is satisfied, the recording head did not produce the cross-talk, and the printing quality was good.

As described in the foregoing, the top plate structure with the jaw can provide the liquid jet recording head without the cross-talk and with good printing quality. In addition, the yield of the prints are increased. In addition, the manufacturing cost is decreased.

If the jaw structure is employed, and simultaneously, the line pressure generating portion 6 is used, the assembled head can be stabilized in the synergism, and therefore, the combination is preferable.

TABLE 1

| No. | a (μm) | b (μm) | c (μm) | Formability | Orifice formation | Cross-talk | Total evaluation |
|---|---|---|---|---|---|---|---|
| 1 | 20 | 3 | 5 | G | G | N | N |
| 2 | 20 | 5 | 5 | G | G | F–G | F–G |
| 3 | 20 | 10 | 5 | G | G | G | G |
| 4 | 20 | 15 | 5 | G | G | G | G |
| 5 | 20 | 20 | 5 | G | G | G | G |
| 6 | 20 | 30 | 5 | G | G | G | G |
| 7 | 20 | 40 | 5 | G | F | G | F |
| 8 | 20 | 50 | 5 | G | N | — | N |
| 9 | 10 | 10 | 5 | N | — | — | N |
| 10 | 15 | 10 | 5 | G | G | G | G |
| 11 | 20 | 10 | 5 | G | G | G | G |
| 12 | 30 | 10 | 5 | G | G | G | G |
| 13 | 40 | 10 | 5 | G | G | G | G |
| 14 | 50 | 10 | 5 | G | G | G | G |
| 15 | 60 | 10 | 5 | G | N | — | N |
| 16 | 20 | 10 | 10 | G | G | G | G |
| 17 | 20 | 10 | 3 | G | G | F | F |
| 18 | 20 | 10 | 2 | G | G | N | N |
| 19 (Comparison 1) | 20 | 0 | 5 | G | G | N | N |
| 20 (Comparison 2) | 40 | 0 | 5 | G | G | N | N |
| 21 (Comparison 3) | 20 | 0 | 10 | G | G | N | N |
| 22 (Comparison 4) | 40 | 0 | 10 | G | G | N | N |

G: Good
F: Fair
N: No good

FIG. 11 shows an example of coupling and fixing the heater board 100 with the top plate 400. In this Figure, the front apron 501 (line pressure generating portion) and the orifice plate portion 404 of the top plate are shown by chain lines for the sake of simplicity. In addition, the wiring pattern on the heater board 100 is omitted for the same reason. As described in the foregoing, the purpose of alignment between the heater board 100 and the top plate 400, an end surface of the heater board 100 is abutted to the orifice plate 404. During this, a bonding material 405 is applied along the three peripheral sides of the top plate 400.

Then, the combined top plate 400 and the heater board 100 (recording head) is fixed on the supporting member 300 by a bonding agent 306.

In this state, the two members (heater board 100 and the top plate 400) are bonded only at the peripheral portions other than the ink passages, and therefore, the press-contact is not sufficient. Then, the urging force is applied by a confining spring 500 to the top of the top plate 400. Pawl 507 of the lateral legs thereof are inserted into the holes 307 of the supporting member 300 to clamp them, by which the mechanical pressure is applied to the top of the top plate 400. By doing so, the two members are sufficiently press-contacted. The confining spring 500 has a hole 520 to permit penetration of a supply pipe connecting an ink inlet of the top plate 400 and the ink supply port of the ink supply container 600.

In the manufacturing of the recording head described in the foregoing, there is no bonding step for bonding the orifice plate (ejection outlets forming member) to the other member. Therefore, the positioning at the time of the bonding is not required. In addition, because of the unnecessity of using the bonding agent, the ink passages can be prevented from clogging thereby.

Figure 12A:
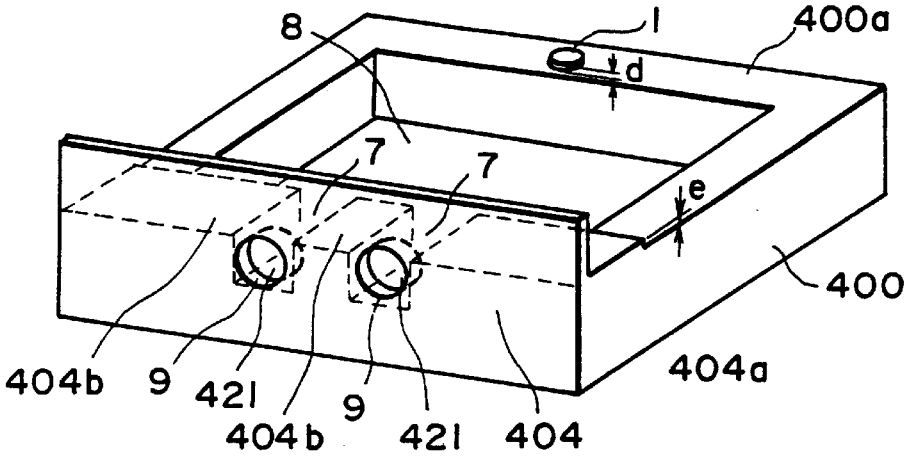
Figure 12B:
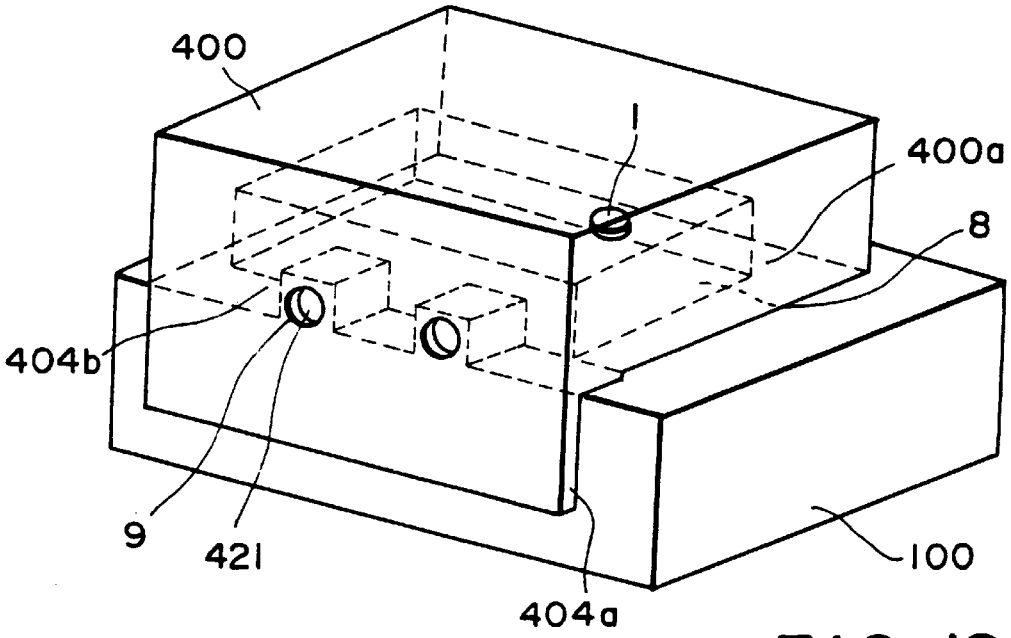
Figure 12C:
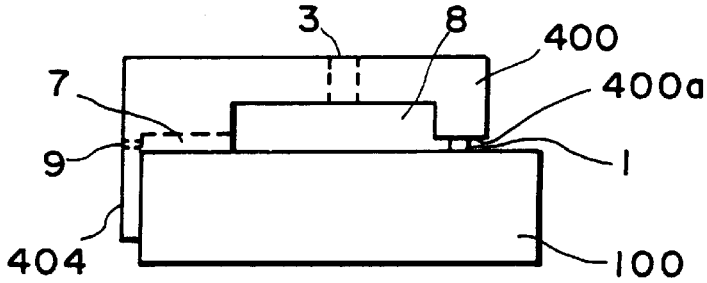

Referring to FIGS. 12A, 12B and 12C, a further improvement will be described. When a first base member 1 and a second base member 2 are bonded by a bonding agent, a high molding accuracy is required so as to eliminate inclination or deviation between the first base member and the second base member.

However, when the inclination of the direction of arrangement of the ink passage walls 404*b* formed in the second base plate is different from the inclination of the wall portions 400*a* at the rear end of the common chamber 8, that is, the manufacturing accuracy is not high, the joint surface with the first base plate is not uniform. If this occurs, the first base plate and the second base plate are not aligned without local play. In this case, the ink can enter the clearance provided by the play, or the pressure provided by the bubble upon the ink ejection transmits through the clearance, and therefore, the ejection energy for the ink droplet is wasted. The printing quality is decreased.

On the other hand, the thickness of the bonding agent in the clearance between the first base plate and the second base plate is non-uniform in some cases, with the result that the ink leaks from a part of the recording head to contaminate the electric circuit in the apparatus, and therefore, malfunction occurs.

In the embodiment of FIGS. 12A–12C, a projection is formed at a wall of the second base plate constituting the common ink chamber and at a portion of the joint surface with the first base plate.

According to this embodiment, the projection is effective to maintain the parallelism of the ink passage, and therefore, the press-contact between the ink passage wall surfaces and the first base plate is enhanced by which the ink droplet ejection performance is improved.

In addition, upon the coupling between the first base plate and the second base plate, it is not necessary to use the bonding agent, and therefore, the bulging of the bonding agent which can clog the ink passage, does not occur.

In FIG. 12A, the top plate 400 has ink passages 7, a recess 404*a* for providing a common ink chamber 8 and walls 404*b* and 404*a*. To the top plate 400, an orifice plate 421 having ejection outlets 9 communicating with the ink passages 7 is integrally mounted. At a rear end portion of the wall 400*a* constituting the common ink chamber 8 is provided with a projection 1 having a predetermined height. The projection 1 is disposed in a predetermined region in the rear wall 400*a* of the common chamber 8, preferably at the center of the rear wall 400*a*. By doing so, the balance is good when coupled with the base plate 100.

Then, the force is applied at a point of the projection relative to the linear arrangements of the ink passage walls 404*b*, and therefore, the inclination and deviation between the base plate and the top plate are not needed to be concerned.

On the other hand, the wall 404*b* of the top plate 400 has a thickness larger by d than the wall 400*a* of the common chamber 8, so that a step is provided. The step provides a clearance through which the bonding agent enters upon the joint between the base plate 100 and the top plate 400.

The projection 1 has a height d substantially corresponding to a thickness e corresponding to the step c in FIG. 10. Therefore, as shown in FIGS. 12B and 12C, the bonding agent applied to the periphery at the junction surfaces between the base plate 100 and the top plate 400 uniformly enters the joint surfaces of the base plate 100 and the top plate 400.

In this embodiment, the top plate and the orifice plate are integrally molded, the orifices and the ink passages are prevented from being clogged by the bonding agent.

Figure 13:
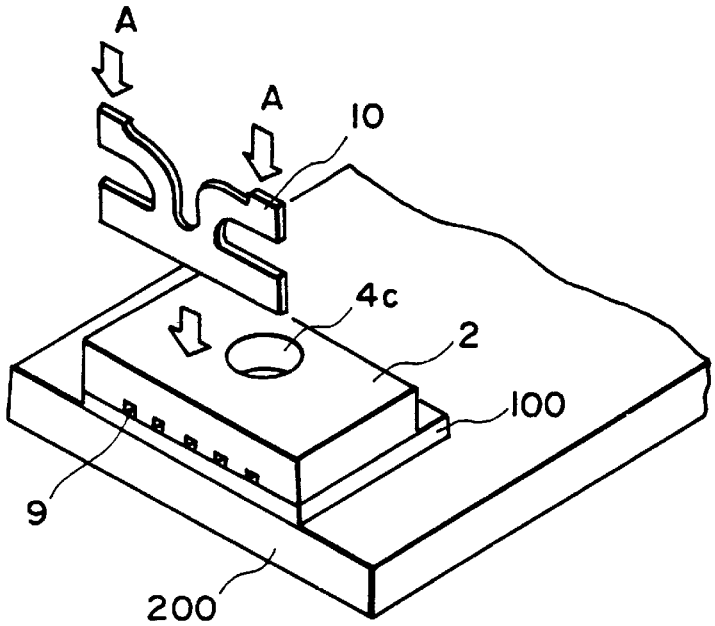
FIG. 13 is a perspective view of an ink jet recording head of FIGS. 1 or 12.

FIG. 13 shows a modified embodiment of the linear pressure generating member, wherein the forces at the left and right sides are uniformly distributed, by which the clamping is effected adjacent the ejection outlets. The configurations of the linear pressure generating member is not limited to the configuration of the foregoing embodiments, but as in this embodiment, the position where the forces are applied may be separate.

Figures 14A, 14B:
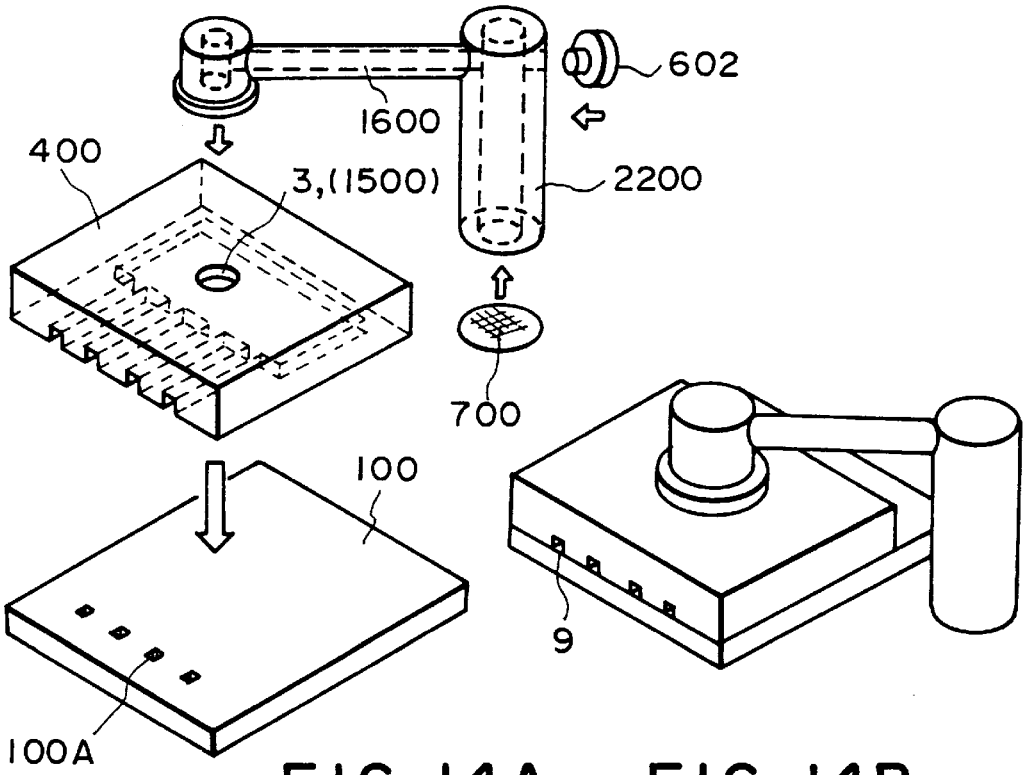
FIG. 14A and FIG. 14B are an exploded perspective view and an assembled perspective view of an ink jet cartridge according to an embodiment of the present invention having an ink supplier.
Figure 15:
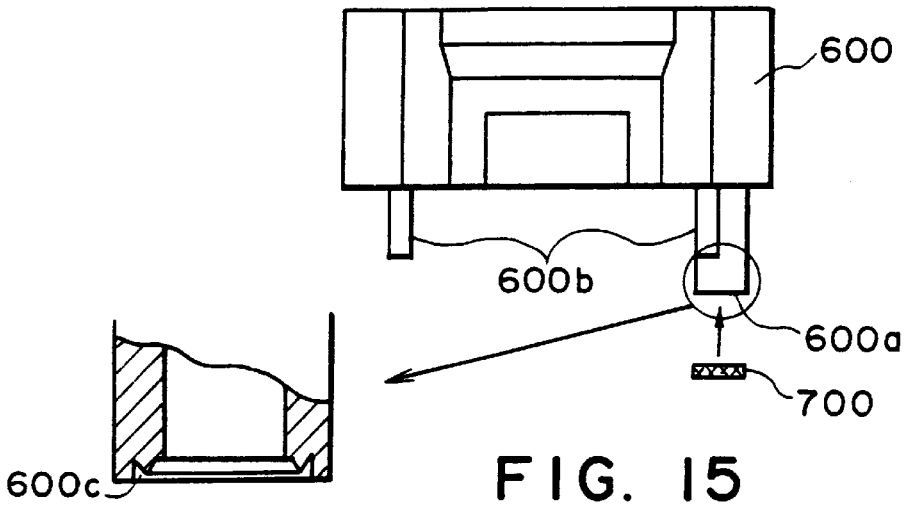
FIG. 15 is a front view of a part of an ink supplier of an ink jet recording unit according to an embodiment of the present invention.

FIGS. 14A, 14B and 15 are enlarged views of the structure described in conjunction with FIG. 2. In FIG. 14A, a reference numeral 400 designates a top plate (ink passage defining member) provided with grooves for constituting ink passages communicating with ink ejection outlets 9; 100 designates a heater board having a heater 100A (ejection energy generating element) for generating energy contributable to ejection of the ink; 1600 is an ink conduit of a cantilever structure integrally formed with an ink supply pipe 2200 for supplying the ink from the ink container to the ink receptor port 1500 of the top plate 400. The top plate 400 and the heater board 100 are press-contacted by the above-described leaf spring or confining spring. The ink conduit 1600 and the ink supply pipe 2200 are integral with the ink supply member 600 (FIG. 2) which is a constituent element of the ink jet recording head.

FIG. 14B shows a schematic perspective view of an ink jet unit. To the ink receptor port 1500 of the top plate, an elastic force by the flexing of the ink conduit 1600 is applied, and an end of the ink conduit 1600 press-contacted to the ink receptor port 1500. As an example, the pressure by the flexing is approximately 100–200 g. In this manner, the ink conduit has substantially a free end press-contacted to the ink passage defining member and the other end fixed to the ink supply member as the base of the press-contact, thus constituting a cantilever structure.

The ink conduit 1600, the ink supply pipe 2200 and the ink supply member 600 are molded integrally with resin material such as polysulfone, however, it is very difficult due to the structure to form a complete ink supply passage only by the molding, and therefore, a sealing pin 602 is press-fitted in the ink supply pipe 2200 to constitute the closed ink supply passage. When the ink supply member 600 is incorporated in the ink cartridge, the end of the ink supply conduit 1600 is press-contacted to the top plate 400. In order to enhance the press-contact, a sealing agent such as PSE 399 black (trade name, available from Toshiba Silicone Kabushiki Kaisha, Japan) may be applied by the press-contact portion the sealing agent may be used to simultaneously protect the wire bonding pads for the establishment of the electric connections.

An end of the ink supply pipe 2200 provided with a filter 700 is pressed against a foaming material impregnated with the ink in the ink container to be fed with ink.

FIG. 15 shows a structure of an ink supply container.

In this embodiment, the supply container 600 is molded with the resin material exhibiting good resistivity against the ink, similarly to the case of the top plate 400. The ink supply container 600 having the filter 700 fused to the ink introduction port 600*a* from the ink cartridge is positioned and fixed to the recording head. Upon the positioning, the positioning pin 600*b* has been molded on the supply container 600, and the positioning pin 600*b* is inserted into a through hole in the supporting member 300, and the pin is fused to the supporting member 300 at the backside thereof. In this embodiment, the connection between the ink supply container 600 and the filter 700 and between the supply container 600 and the supporting member 300, are effected by the fusing, but the fixing therebetween can be made by different method. However, as regards the connection between the supply container 600 and the filter 700, the bonding agent, if used, can enter into the mesh of the filter 700, and therefore, it is difficult to assure the effective area. However, in this embodiment in the fusing of the filter, the filter fusing portion of the supply container is provided with a recess 600*c* for the filter positioning, as shown in FIG. 15, and after the fusing, the recess 600*c* protects the filter 700. Therefore, even if the ink supply container 600 is frequently exchanged, the filter 700 is not separated.

Therefore, the cartridge shown in FIGS. 2 and 3 can be produced with the ink supply member as described above. Further, an ink jet printer, or an ink jet printer using the reusable cartridge can be provided.

In the foregoing embodiments, the body of the recording head is integral with the ink supply source, but they may be separate in which case the ink supply source is disposable. However, either of them is reusable or disposable. Even in the case of a fixed recording head type (not disposable), the simple structure and low cost head is effective to reduce the cost of the printer.

According to the embodiments of FIGS. 14 and 15, (1) no flexible tube is required, and therefore, a tube connecting step can be eliminated, and the manufacturing cost can be reduced because of the elimination of the necessity of the flexible tube.

(2) Since the cantilever structure is employed, the deformation of the ink conduit is effective not only to press the ink conduit itself to the top plate, but also to press the top plate to the heater board. Therefore, the ink is prevented from leaking through the junction portion and prevents air from entering.

(3) The filter can be provided so that it is not exposed outside through the end of the ink conduit, and therefore, the good ink supply can be accomplished without introduction of foreign matter.

Figure 16:
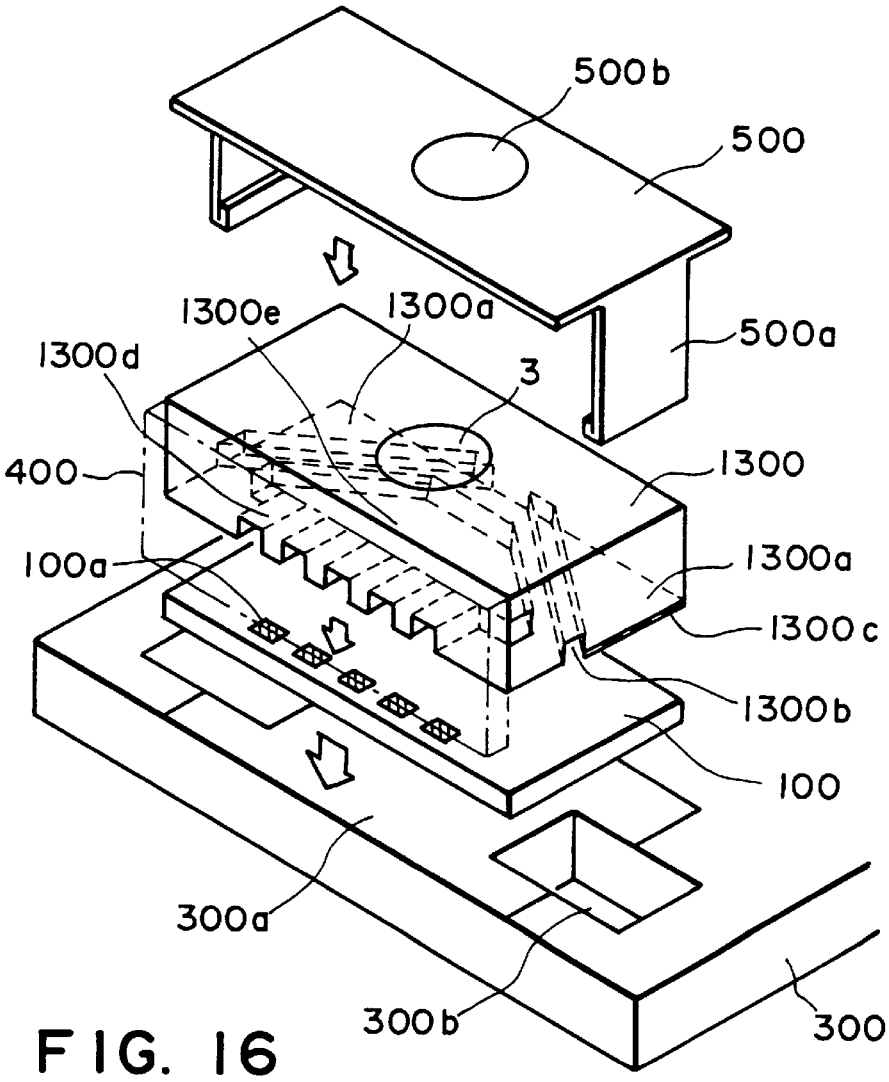
FIG. 16 is an exploded perspective view illustrating an ink jet recording head according to an embodiment of the present invention.
Figure 17:
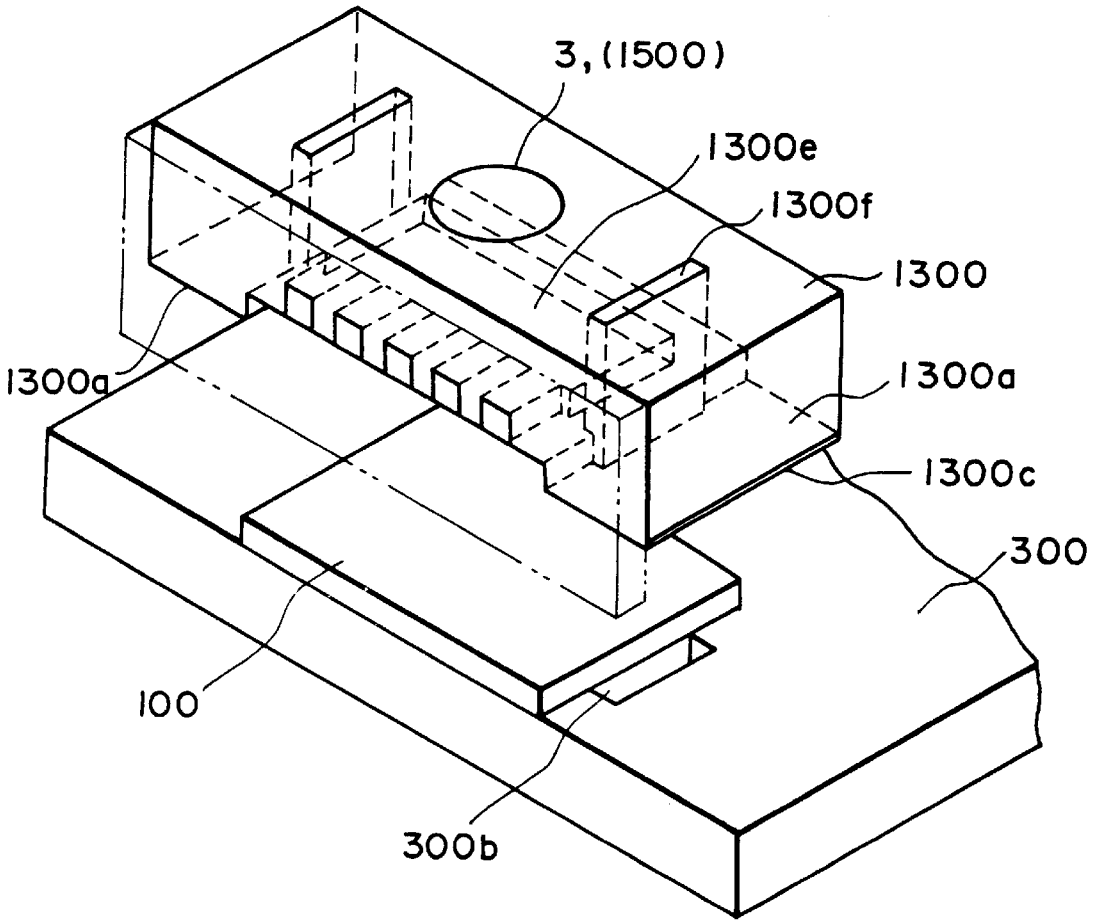
FIG. 17 is a perspective view of an ink jet recording head according to a further embodiment of the present invention.

FIGS. 16 and 17 show further embodiments which solve the following problems: occurrence of positional deviation or stress by curing contraction of the bonding agent, the improper ink ejection due to the clogging or deformation of the ink passage by the bonding agent; change of ink properly by direct contact of the ink to the bonding agent; the formation of gap between the top plate and the heater board by expansion of the bonding agent with the result of cross-talk.

In FIG. 16, the orifice plate 400 integrally molded with the top plate 1300 is shown by chain lines, and the wiring pattern of the heater board 100 is omitted for the sake of simplicity. The ejection outlets are formed in the orifice plate 400 in the manner that they are arranged substantially along the connecting portion between the top plate 1300 and the heater board 100 and in front of the liquid passages 1300*d*.

The alignment between the heater board (base member) 100 and the top plate 1300 is effected by abutting an end of the heater board 100 to the orifice plate 400. A bonding agent 1300*c* is applied to the temporary bonding portion 1300*a* (two portions) provided on the outer ends of the top plate 1300 (the outer end of the common liquid chamber 1300*e* having the shape of generally triangular or trapezoidal as shown in the Figure), and thereafter, they are aligned so that the liquid passages 1300*d* and the electrothermal transducers (heater) 100*a*, and they are bonded temporarily.

In this embodiment, the temporary bonding portion 1300*a* by the bonding material 1300*c* is provided at a position different from the region in which the ink passages are formed, in the contact region between the top plate 1300 and the heater board 100 (the regions are separated by the groove 1300*b* in this embodiment), and therefore, the bonding material 1300*c* or a sealing material is prevented from flowing into the liquid passage 1300*d* and the common chamber 1300*e*.

FIG. 17 shows a modification of the structure of FIG. 16. This embodiment is different from FIG. 16 embodiment as follows. In this embodiment, as shown in FIG. 17, the top plate 1300 is provided with a step, by which the above-described regions are separated. The heater board 100 is bonded to the supporting member 300 by a bonding material, and the bonding material is applied to the both sides of the heater board 100 of the supporting member 300 and/or both of the ends of the top plate 1300, and they are bonded. Similarly to the embodiment of FIG. 16, the bonding agent is prevented from flowing into the liquid passage and the common chamber 1300*e*.

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle are preferably those disclosed in U.S. Pat. Nos. 4,723,129 and 4,740,796. The principle is applicable to a so-called on-demand type recording system and a continuous type recording system. Particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black and a multi-color mode with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material is through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head comprising:

a first member on which are disposed plurality of energy generating elements for generating energy for ejecting ink;

a second member molded from a resin material, and integrally having an orifice plate portion having a plurality of ejection outlets, and a plurality of grooves for constituting a plurality of ink passages in fluid communication with the ejection outlets of said orifice plate portion, respectively, each of said ink passages having an ejection outlet side end located nearer to a center of said second member than said election outlets;

a confining spring for confining said first and said second members to be press-contacted to each other by a concentrated line pressure at a portion above the grooves, by which the ink passages are constituted with said ejection energy generating elements contained therein;

wherein said second member has an abutment surface relative to and facing said first member and said abutment surface is an inner surface of said orifice plate portion lying in a plane perpendicular to a direction of ink discharge, and the inner surface of said orifice plate portion lying in a plane parallel to the direction of ink discharge disposed between the ejection outlet side ends above and the abutment surface below is press-contacted to said first member.

2. An ink jet head according to claim 1, wherein said energy generating elements are electrothermal transducers.

3. An ink jet head according to claim 1, wherein said second member has a recess forming a common ink chamber in fluid communication with said ink passages, a plurality of first walls for constituting said ink passages, a second wall forming a recess for constituting a common ink chamber, said second wall being stepped relative to said first walls and being provided with a projection at a rear end thereof with respect to a direction of ink ejection, which projection protrudes downward from the said second wall towards the first member.

4. An ink jet head according to claim 3, wherein said projection is disposed at a central portion of said second wall.

5. An ink jet head according to claim 3, wherein said projection has a height equal to a height of the stepped portion.

* * * * *

UNITED STATES PATENT AND TRADEMARK OFFICE

CERTIFICATE OF CORRECTION

PATENT NO. : 6,135,589
DATED : October 24, 2000
INVENTOR(S) : Hiroshi Nakagomi et al.

It is certified that error appears in the above-identified patent and that said Letters Patent is hereby corrected as shown below:

Column 5,
Line 18, "the rib" should read -- ribs --;
Line 42, "an available part" should read -- parts --; and
Line 43, "constituting" should read -- constitute --.

Column 7,
Line 43, "conventional" should read -- in a conventional --; and
Line 54, "expected" should read -- unexpected --.

Column 10,
Line 3, "plate 1" should read -- plate 100 --.

Column 12,
Line 67, "the" should be deleted.

Column 13,
Line 3, "the" should be deleted; and
Line 5, "microns" should read -- microns, --.

Column 14,
Line 3, "C" should read -- c --; and
Table 1, "No good" should read -- Not good --.

Column 17,
Line 15, "portion" should read -- portion; --; and
Line 35, "by" (2nd occurrence) should read -- by a --.

Column 18,
Line 67, "provide" should read -- provided --.

UNITED STATES PATENT AND TRADEMARK OFFICE

CERTIFICATE OF CORRECTION

PATENT NO. : 6,135,589
DATED : October 24, 2000
INVENTOR(S) : Hiroshi Nakagomi et al.

It is certified that error appears in the above-identified patent and that said Letters Patent is hereby corrected as shown below:

Column 20,
Line 12, "it is left is used" should read -- unused --;
Line 20, "is" should read -- in --;
Line 27, "computer" should read -- a computer --;
Line 37, "plurality" should read -- a plurality --; and
Line 48, "outlets;" should read -- outlets; and --.

Signed and Sealed this

Twenty-sixth Day of February, 2002

*Attest:*

*Attesting Officer*

JAMES E. ROGAN
*Director of the United States Patent and Trademark Office*